United States Patent [19]

Steinberg

[11] Patent Number: 4,868,990

[45] Date of Patent: Sep. 26, 1989

[54] GARMENT MEASURING SYSTEM

[75] Inventor: Bernard J. Steinberg, New York, N.Y.

[73] Assignee: Executive Fit, Inc., New York, N.Y.

[21] Appl. No.: 192,771

[22] Filed: May 11, 1988

[51] Int. Cl.[4] ..... A41H 1/02

[52] U.S. Cl. ..... 33/15; 33/755

[58] Field of Search ..... 33/11, 14, 15, 16, 137, 33/755

[56] References Cited

U.S. PATENT DOCUMENTS

| | | | |
|---|---|---|---|
| 78,325 | 5/1868 | Rand . | |
| 358,903 | 3/1887 | Weir . | |
| 545,139 | 8/1895 | Start et al. | 33/14 X |
| 579,491 | 3/1897 | Meas | 33/15 |
| 1,039,233 | 9/1912 | Western . | |
| 1,121,410 | 12/1914 | Scribante . | |
| 1,732,369 | 10/1929 | Leeman . | |
| 1,784,889 | 12/1930 | Couture | 33/15 |
| 2,199,530 | 5/1940 | Thompson | 33/15 |
| 2,471,196 | 5/1949 | Cieri . | |
| 2,615,250 | 10/1952 | Fessler . | |
| 2,762,124 | 9/1958 | D'Angelo . | |
| 2,858,832 | 11/1958 | Loeffel et al. . | |
| 3,034,216 | 5/1962 | Fossey . | |
| 3,067,516 | 12/1962 | Jones . | |
| 3,091,861 | 6/1963 | Jones . | |
| 3,493,973 | 2/1970 | Wolheim . | |
| 4,184,260 | 1/1980 | Brockman . | |
| 4,211,011 | 7/1980 | Jacobson | 33/15 |
| 4,635,367 | 1/1987 | Vigede . | |

FOREIGN PATENT DOCUMENTS

| | | | |
|---|---|---|---|
| 112957 | 4/1941 | Australia | 33/15 |
| 0963498 | 10/1982 | U.S.S.R. | 33/15 |

*Primary Examiner*—Harry N. Haroian

*Attorney, Agent, or Firm*—Jones, Tullar & Cooper

[57] ABSTRACT

A garment measuring system uses several sections which act in concert to provide accurate physical dimensions of the person for whom a garment is to custom made. The several sections have integral measuring calibrations which allow the direct taking of appropriate measurements while affording the person the opportunity to see how the garment to be produced will actually look and feel.

21 Claims, 4 Drawing Sheets

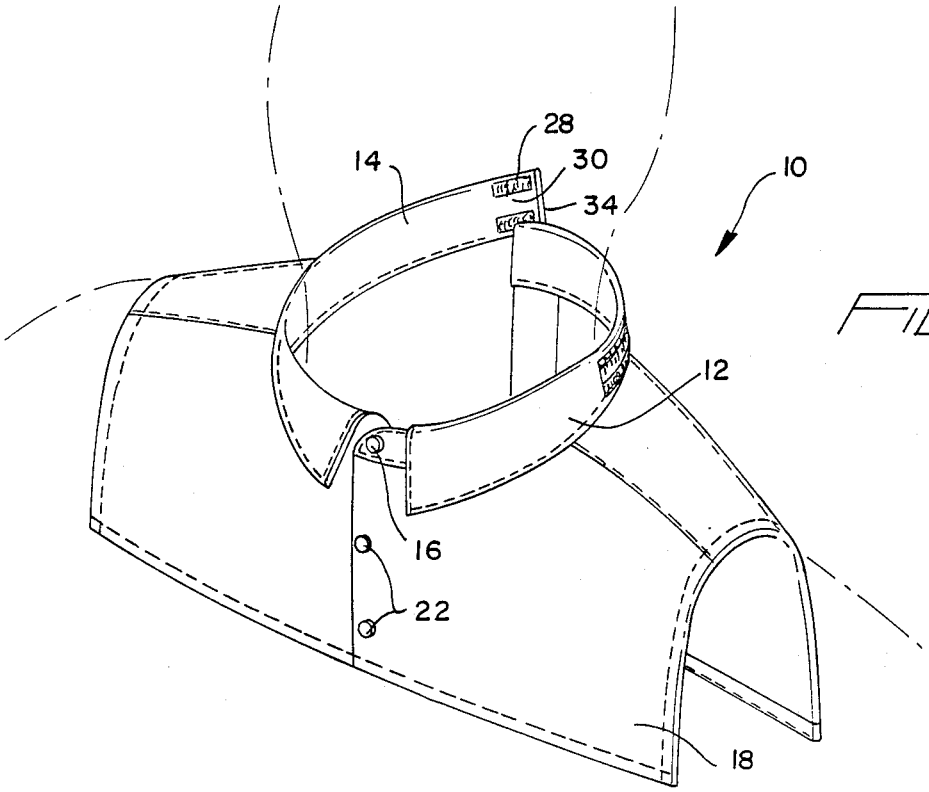
FIG 1
FIG 2
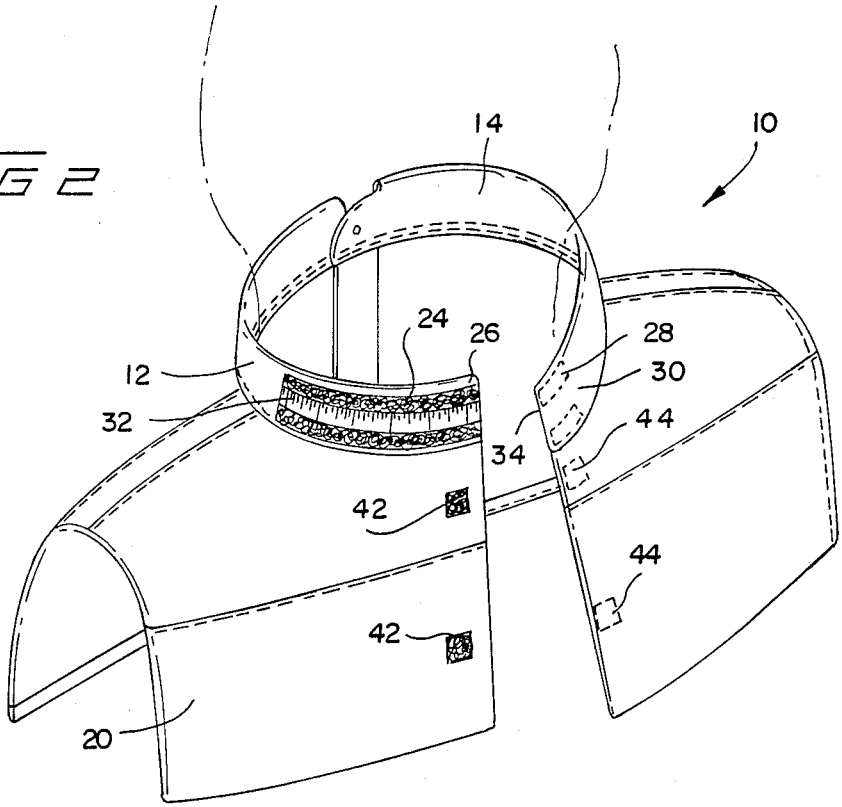

GARMENT MEASURING SYSTEM

FIELD OF THE INVENTION

The present invention is directed generally to a garment measuring system. More particularly, the present invention is directed to a shirt measuring system. Most specifically, the present invention is directed to a custom shirt measuring system utilizing a group of cooperating sections. The various sections are placeable on a person in a particular sequence by a salesperson who is measuring the person for whom the garment is to be made. Each section is structured to simulate the look and fit of a portion of the garment which will be produced using the measurements derived from the system. Each section of the garment measuring system utilizes integral measuring indicia to facilitate the taking of accurate, appropriate measurements by the salesperson in an expeditious manner.

DESCRIPTION OF THE PRIOR ART

Garments, such as shirts are typically sold in various standard sizes or are available in custom made sizes which are dictated by the individual characteristics of the person for whom the garment is intended. A standard, or ready to wear garment is less expensive than a custom garment but is not nearly as satisfactory in fit and comfort. Custom made garments are certainly more desirable because they are made to the individual measurements of the wearer. However, the selling costs associated with custom garments have contributed to making them substantially more expensive than so called standard or ready to wear garments. This has been particularly true with respect to men's shirts where a significant portion of the selling cost of the shirt has been the time required by a skilled tailor, working with a tape measure, to accurately measure the person for whom the shirt is being made. Thus a custom shirt has been a desirable but quite expensive alternative to a standard sized garment.

It is generally known in the prior art to provide a trial garment or garment components which can be used to adapt a garment to the particular characteristics of the wearer. Various measuring jackets, trial coats and similar devices have been proposed as ways to adapt a garment, such as a coat, to the individual's size requirements. In most instances, these trial garments or components have been bulky, cumbersome affairs which required significant skills on the part of the person whose task it was to adapt the trial garment to the wearer. Once the trial garment had been adapted, it was then necessary to correctly and accurately transfer the measurements from the trial garment to a pattern from which the final garment would be produced.

In most instances, the adaptation of the trial garment, the taking of the measurements, the application of the measurements to a pattern, and the production of the resultant article of clothing were all accomplished by the same individual who was usually a tailor or skilled seamstress. While such a complex procedure was acceptable when labor was less expensive and when the finished garment might be worn for a number of years, it is clearly not a viable approach to the making of custom garments in today's market where labor is costly and where skilled tailors and seamstresses are becoming increasingly unavailable.

As indicated above, prior garment adaptation systems have typically required the services of an experienced tailor or seamstress. In today's changing retail sales environment, the services of such a person are apt to not be available, and if they are available, only at a high cost. The presently available procedures for adapting a trial garment or component to the individual who will be wearing the finished product require a level of skill, training, and judgment that is not quickly and easily taught. Thus the selling cost of custom garments, such as shirts has remained high because it has been difficult to train and keep salespersons who can properly use these prior art garments or components to fit the trial garment to the person, who can take the necessary measurements, and who can provide the manufacturer with the necessary measurements which will allow the garment to be made to the wearer's satisfaction.

It will thus be apparent that a need exists for a garment measuring system which will quickly, accurately, and correctly allow a salesperson not having extensive tailoring skills to take the measurements needed to allow a manufacturer to produce a custom garment such as a shirt. The prior art devices clearly do not provide such a system. The garment measuring system of the present invention does provide this system and is a significant advance in the art.

SUMMARY OF THE INVENTION

It is an object of the present invention to provide a garment measuring system.

Another object of the present invention is to provide a custom shirt measuring system.

A further object of the present invention is to provide a garment measuring system which uses cooperating sections.

Yet another object of the present invention is to provide a garment measuring system in which measurements are taken directly from the various sections.

Still a further object of the present invention is to provide a garment measuring system useable by salespersons with little tailoring skills.

Even yet another object of the present invention is to provide a custom garment measuring system which can demonstrate various styles of garments.

Still even a further object of the present invention is to provide a garment measuring system which is effective and not complex.

As will be discussed in the description of the preferred embodiment which is set forth subsequently, the garment measuring system in accordance with the present invention is primarily directed to the taking of measurements which will be used in the manufacture of men's custom shirts. A group of sections, which each are representative of those parts of a shirt that require measurements, are provided to a salesperson. These sections, which include a collar section, left and right yoke sections, left and right sleeve sections, and a tape section, each include suitable fastening devices and appropriately placed measurement taking calibrations or indicia portions. In use, the several sections are used in concert with each other to arrive at the appropriate measurements, taken in the proper locations, to allow the manufacturer to make a correctly fitting and appearing garment in accordance with the wearer's personal characteristics and taste.

In marked contrast to the complex, labor intensive garment adaptation devices of the prior art which required the time and talents of a skilled, experienced tailor or seamstress, the garment measuring system of the present invention utilizes several cooperative sections to allow a salesperson to properly and accurately measure the person for whom the garment is to be made. The salesperson can be quickly and easily taught how to use the garment measuring system of the present invention and does not need to be an experienced tailor or seamstress. This significantly reduces the selling cost of the finished garment, such as a shirt, and thus allows the price of a custom shirt to be a reflection of its superior quality and fit instead of being a result of high labor costs required by the taking of the measurements used to make the shirt. The garment measuring system of the present invention also allows one central manufacturing facility to receive measurements from a number of different retail stores while being assured that each of the salespersons providing the measurements are using the same procedures and systems. This assures that the resulting custom garment will possess superior fit and appearance and will also be more competitive with the ready to wear one on a price basis.

The garment measuring system in accordance with the present invention uses the several sections in concert to take the measurements required to produce a properly fitting shirt. In addition, it allows the person who will be wearing the shirt to make the type of custom changes that are important to him. For example, he may prefer his collar tight or loose, his sleeves long or short and his cuffs tight or loose. He may prefer that the sleeve length of his more active arm be increased. All of these individual desires can be quickly and easily accommodated with the present invention. Each section has suitable hook and loop fasteners and carries appropriate indicating calibrations so that the exact sizes which make the differences between a custom shirt and a standardized shirt can be easily ascertained and accurately measured.

The garment measuring system of the present invention provides both measuring and style capabilities. The collar section will allow the customer to have his collar size custom fitted. It can also show him how he will look with one of several collar styles by providing collar sections with various collar styles. In a similar manner, the sleeve sections may include several cuff styles so that the customer can determine what size he wants his cuff to be as well as affording him the opportunity to see how various cuff styles actually look on him. This dual function of proper fit and style selection is not available in prior art garment adaptation devices and further enhances the attractiveness of the present invention.

It will be appreciated that the garment measuring system in accordance with the present invention provides a much superior system over prior art devices. It does not require skilled or expensive labor. It allows measurements to be taken and transferred to a manufacturer in an accurate, dependable manner, and it allows the customer to truly customize his or her garment, such as a shirt or blouse while seeing what style the finished product will be. The present invention allows a custom shirt to compete with a standard sized shirt and is a substantial advance in the art.

BRIEF DESCRIPTION OF THE DRAWINGS

While the novel features of the garment measuring system in accordance with the present invention are set forth with particularity in the appended claims, a full and complete understanding of the invention may be had by referring to the detailed description of the preferred embodiment which is set forth subsequently, and as illustrated in the accompanying drawings, in which:

FIG. 1 is a front perspective view of a collar measuring section in accordance with the present invention and having a small front and yoke attached;

FIG. 2 is a rear perspective view of the collar measuring section of FIG. 1;

DESCRIPTION OF THE PREFERRED EMBODIMENT

Figure 3:
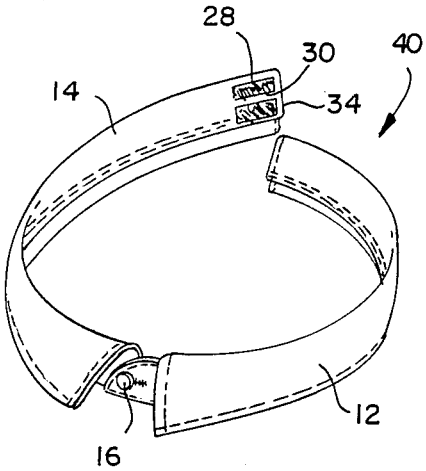
FIG. 3 is a front perspective view of a collar measuring section without a front or yoke attached.

Referring initially to FIGS. 1 and 2, there may be seen a preferred embodiment of a collar size measuring section, generally at 10, of the garment measuring system in accordance with the present invention. Collar measuring section 10 is generally simulative of a typical shirt collar and includes an outer collar portion 12, an inner neck portion 14, and a collar closure button 16 which, in this collar simulating section, is non-functional. To enhance the similarity of appearance between collar measuring section 10 and an actual shirt, collar measuring section 10 is provided with a small front portion 18 and a small yoke portion 20. Front portion 18 may be provided with several non-functional front buttons 22.

As is shown in phantom lines in FIGS. 1 and 2, collar measuring section is used to properly measure the neck of the person for whom the custom shirt will be made. This is accomplished by placing a first portion 24 of a collar section hook and loop fastener on a rear end 26 of outer collar flap 12; and by placing a second portion 28 of the collar section hook and loop fastener on the rear portion 30 of neck flap of collar measuring section 10. A section of measuring tape 32 is attached to the rear collar flap 26 and is preferably placed between spaced upper and lower collar flap portions 24 of the collar hook and loop fastener. This collar section measuring tape 32 is suitably calibrated in such a manner that it will, in cooperation with an edge 34 of rear neck flap 30, provide a direct indication of the neck size of the person about whose neck the collar measuring section is placed.

Figure 4:
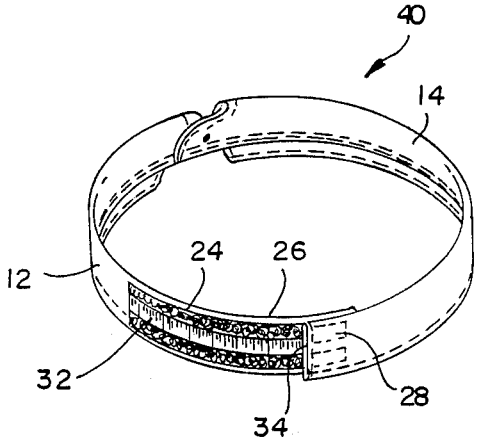
FIG. 4 is a rear perspective view of the collar measuring section of FIG. 3.

In use, the person whose measurements are being taken is asked to remove his shirt so that collar measuring section 10 can be properly placed. If he is reluctant to do so, or if the measurements are being taken in a quasi-public area, an alternate collar measuring section; generally at 40 in FIGS. 3 and 4 may be used. This alternate collar measuring section 40 is the same as the collar measuring section 10 with the deletion of the front portion 18 and the small yoke portion 20. To use this alternate collar measuring section 40, the person need only unbutton the upper several buttons of his shirt and loosen his tie. In either instance, the salesperson will place the collar measuring section 10 or 40 about the person's neck while working behind the person, and will place the neck flap fasteners 28 on the collar flap fasteners 24 so that the neck flap edge 34 overlies the collar flap or neck measuring tape 32. Now the person being measured can instruct the salesperson to tighten or loosen the collar in accordance with his individual tastes. Once this has been done, the salesperson can directly read the neck size from the neck measuring tape 32. If desired, the neck measuring portion 10 can be left on the person during further size measurements. To help this section to be kept in place, the split rear small yoke may have spaced hook and loop fasteners 42 and 44. Also, if desired, the collar measuring section 10 or 40 may be formed having various collar styles so that the person who is being measured can see what these collar styles will look like as he wears them.

Figure 5:
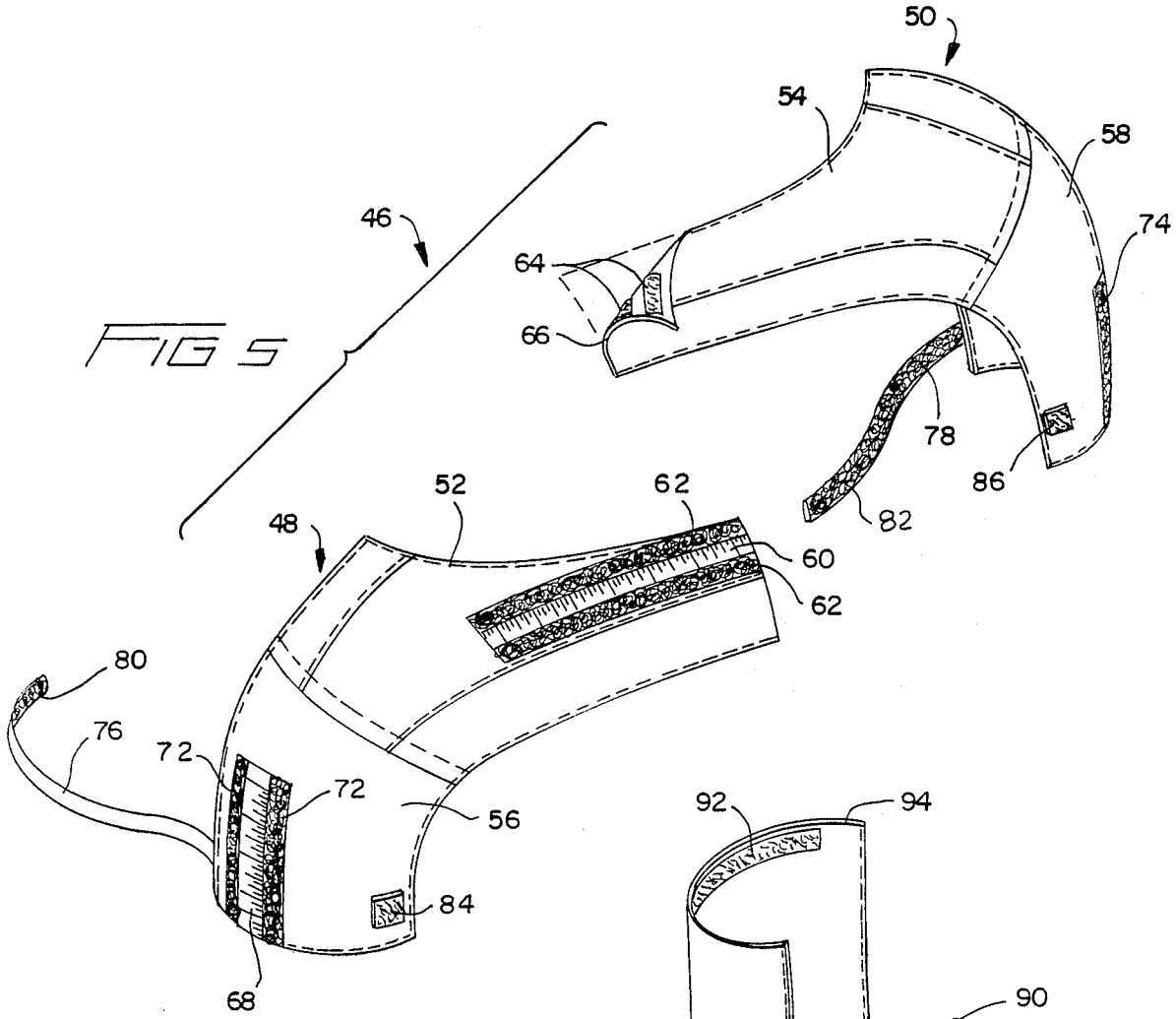
FIG. 5 is a rear perspective view of a yoke measuring assembly including left and right yoke measuring sections.

Turning now to FIG. 5, there may be seen a yoke portion of the garment measuring system generally at 46. Yoke portion 46 includes a left yoke section 48 and a right yoke section 50. Each of these yoke sections 48 and 50 has a shoulder engaging panel 52 and 54, respectively, and an upper sleeve attaching panel 56 and 58, respectively. Left yoke section 48 also has a yoke measuring tape 60 bounded by elongated first segments 62 of a yoke hook and loop fastener. This tape 60 and fastener portion 62 is placed on the left yoke shoulder panel 52 and cooperates with second segments 64 of the yoke hook and loop fastener on the right yoke shoulder panel 52. As with the collar sections, end 66 of right shoulder panel 54 cooperates with yoke measuring tape 60 when the right shoulder panel 54 is placed atop the left shoulder panel 52 and the two are held by the hook and loop fasteners 62 and 64 to provide a yoke measurement.

Each sleeve attaching panel 56 and 58 of left and right yoke sections 46 and 48, respectively carries a sleeve length measuring tape 68 and 70, respectively. These sleeve length measuring tapes 68 and 70 extend generally vertically on the outer surface of their sleeve attaching panels 56 and 58 and are bounded by first portions 72 and 74 of sleeve panel hook and loop fasteners. A bicep encircling strap 76 and 78, respectively is attached to each of the left and right sleeve attaching panels 56 and 58. The inner end of each bicep strap has a first portion 80, 82 of a hook and loop fastener which cooperates with a second tab portion 84, 86 on the sleeve attaching panel 56, 58, respectively.

Figure 6:
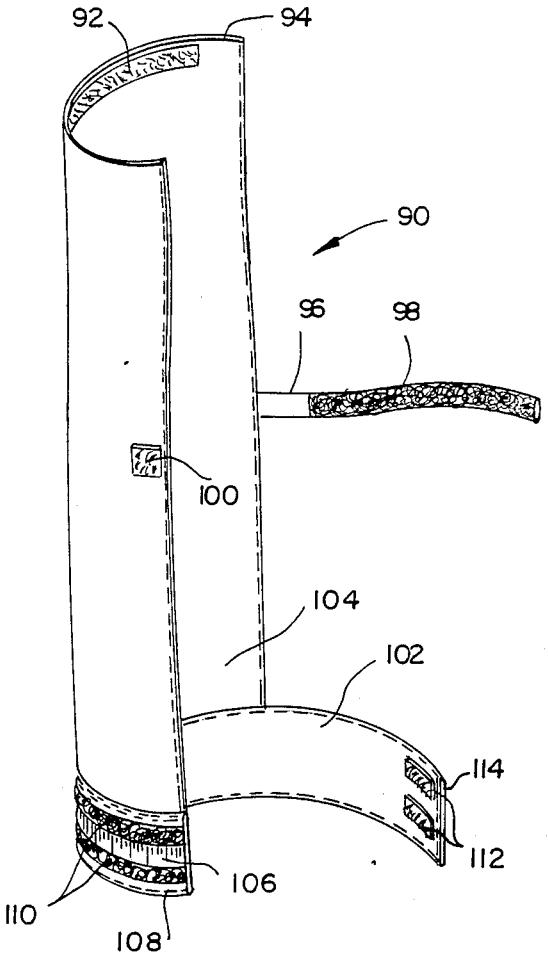
FIG. 6 is a perspective view of a left sleeve and cuff measuring section in accordance with the present invention.

A left sleeve section may be seen generally at 90 in FIG. 6. This sleeve section includes an inner sleeve section portion 92 of a hook and loop fastener at its upper end 94 so that this left sleeve section 90 may be attached to the left sleeve attaching panel 56 on left yoke section 48. The upper edge 94 of left sleeve section 90 cooperates with left sleeve length measuring tape 68, as will be discussed in more detail shortly, to provide an indication of the sleeve length of the wearer. A forearm encircling strap 96 is attached generally at the midpoint of sleeve section 90 and has an inner layer of hook and loop fastening 98 which cooperates with an appropriately placed forearm strap tab 100.

Figure 7:
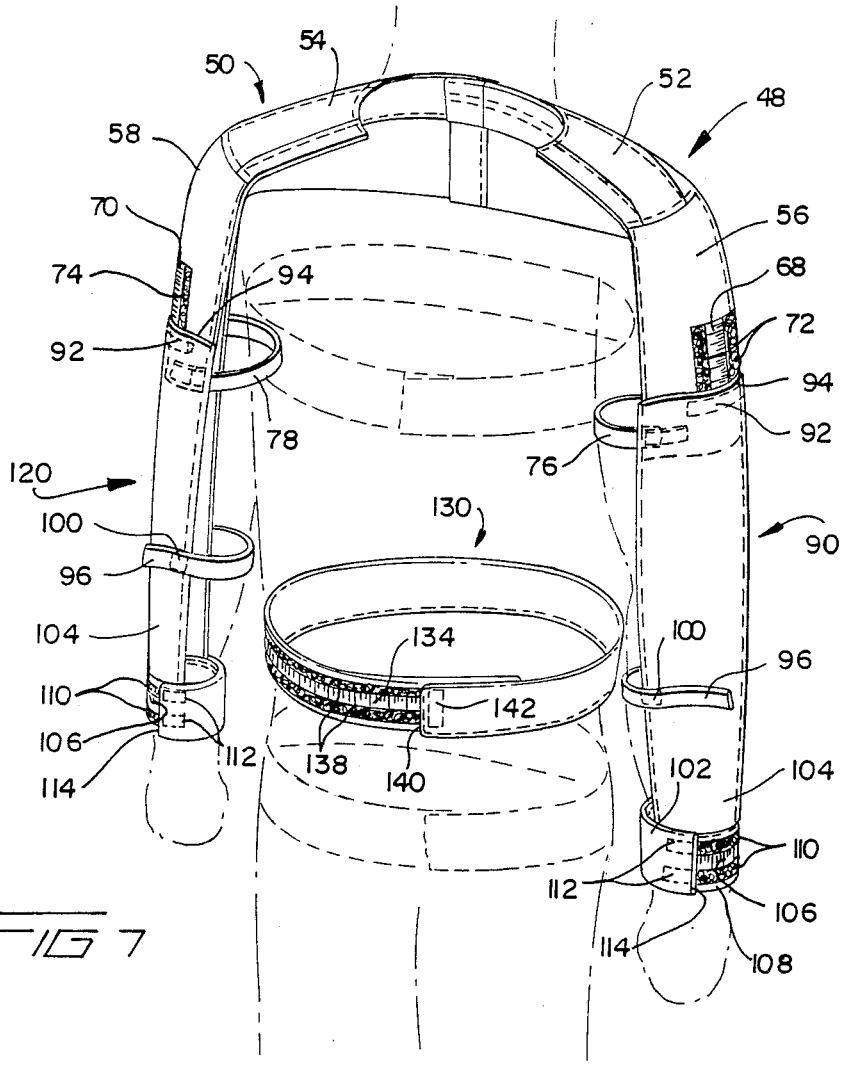
FIG. 7 is a front perspective view of the garment measuring system of the present invention and showing several sections of the invention in place during measurement.

A wrist encircling band 102 is attached at the lower portion 104 of left sleeve section 90. This wrist encircling band 102 carries a cuff or wrist measuring tape 106 on an outer surface of a first end 108 of the wrist encircling band 102. This measuring tape 106 is bounded by first portions 110 of a hook and loop fastener and these cooperate with second portions 112 which are carried on an inner surface of wrist encircling band 102 adjacent a second end 114 of band 102. When wrist encircling band 102 is placed about the wrist of the person being measured, the end 114 cooperates with tape 106 to provide a wrist size measurement while the hook and loop fastening pair 110 and 112 hold the wrist encircling band 102 about the person's wrist. A right sleeve section, generally at 120 is shown in FIG. 7. It is essentially the same as left sleeve section 90 but is its mirror image. Since it is structured and functions the same as left sleeve section 90 it will not be discussed in detail. For convenience, similar elements on both sleeve sections 90 and 120 are similarly numbered.

Referring again to FIG. 7, the useage of the left and right yoke sections 48 and 50 and the left and right sleeve sections 90 and 120 will now be discussed. The left yoke section 48 is first placed on the person's left shoulder so that the juncture of the left yoke shoulder panel 52 with the left sleeve attaching panel 56 is placed just where the arm begins its downward slope as the arm is in a hanging, relaxed position. The left bicep strap 76 is placed about the left bicep of the person and is fastened snugly but not tightly by the cooperation of strap hook and loop fastener portion 80 with cooperating left sleeve attaching panel tab 84. The right yoke section 50 is similarly placed on the right shoulder of the person and the right bicep strap 78 is similarly attached. The end 66 of right yoke shoulder panel 54 is placed atop the yoke measuring tape 60 on left yoke section shoulder panel 52 and the two are held together by the hook and loop fastener segments 62 and 64. The person being measured is asked whether or not he is satisfied with the way the yoke portion 46 sets. If he is, the measurement provided by yoke tape 60 is recorded with the previously recorded collar size measurement from neck tape 32. While not shown in FIG. 7, it will be understood that collar measuring section 10 or 40 may have been left on the person while the yoke 46 is put in place. Although not specifically shown in FIGS. 6 or 7, it will also be understood that bicep encircling straps 76 and 78 may also be calibrated on their outer surfaces to provide a measurement of bicep size. If the garment being measured will be a short sleeved shirt, the sleeve length can be measured directly using sleeve length measuring tapes 68 and 70 with any excess length being turned under to demonstrate to the person how the sleeve length will appear on the finished short sleeve garment.

Assuming that the garment being measured will be a long sleeve shirt, the left sleeve section 90 is now attached to the left sleeve attaching panel 56 of left yoke section 52 by cooperation between hook and loop fastener segments 72 and 92. At this point, the sleeve length is only approximated. The forearm strap 96 is loosely fastened about the person's forearm to assist in holding the sleeve section 90 in place. In a similar manner, the left wrist encircling band 102 is loosely fastened about the person's left wrist. Now the sleeve length can be accurately adjusted to the person's liking and the appropriate measurement taken from left sleeve length measuring tape 68. This same procedure is then followed with the right sleeve section 120 and the right sleeve length taken and recorded. It will often be the situation where the left and right sleeve lengths will not be the same. This is a result of the lack of symmetry of the human body and often results in a longer sleeve length for the person's more active arm. Now the left and right cuff measurements are taken by adjusting the left and right wrist encircling bands 102 and reading the cuff measurements from the cuff measuring tape 106. Again, these cuff measurements may be different. Often a person will want a slightly fuller cuff on the wrist where he wears his watch.

Figure 8:
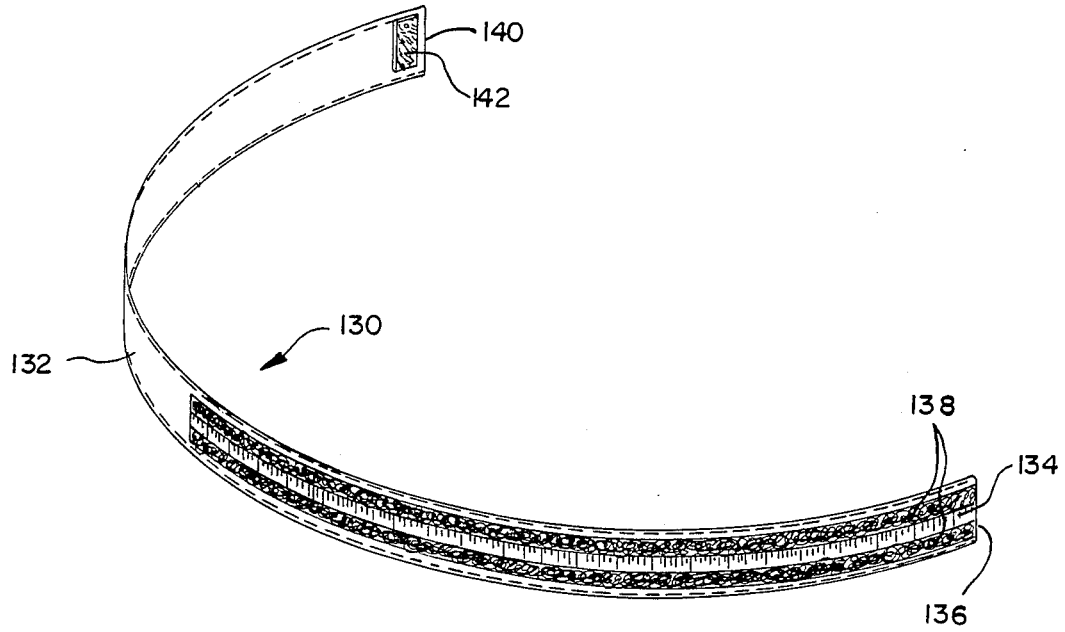
FIG. 8 is a perspective view of a tape section of the garment measuring system of the present invention.

Once these measurements have been taken, the left and right sleeve sections 90 and 120, the left and right yoke sections 48 and 50, and the collar section 10 or 40, if it has been left on, may be removed. Now, as may be seen in FIGS. 7 and 8, a tape section, generally at 130 may be used to take chest, stomach, and hip measurements. Tape section 130, as seen most clearly in FIG. 8, is an elongated strip of material 132 which has a measuring tape 134 at its first end 136. Tape 134 is bounded along its length by first portions 138 of a hook and loop fastener. A second end 140 of elongated strip 132 carries a second portion 142 of the hook and loop fastener on its inner surface. As may be seen in FIG. 7, the tape portion 130 is placed about the chest, stomach and hips of the person being measured and these sizes are read directly from the measuring tape 134 and recorded. Tape section 130 may also be used to measure the tail length of the shirt. With these measurements recorded, the garment measuring process has been completed. The customer may now select colors, materials, and a style such as tapered or full which will be used to make the custom shirts in accordance with the sizes which have been accurately and efficiently determined using the garment measuring system of the present invention.

The various collar sections 10 or 40, the left and right yoke sections 48 and 50, the left and right sleeve sections 90 and 120 and the tape section 130 of the present invention are preferably made of a suitable soft flexible cloth. The depictions of these sections in the several drawing figures do not reflect the softness and flexibility of the material to be used but it will be understood that this is for the purposes of illustration. In actual construction, the garment measuring system sections may be made of a shirting material which will be more similar to the shirts that will be made. Throughout the application, reference has been made to hook and loop fasteners. These will typically be Velcro® or a similar commercially available material. However, other types of cooperative, adjustable fastening means, such as plural snap pairs or the like could be used. Similarly, it is within the scope of the invention to provide the garment measuring system in a single use or disposable format. In such a useage, the several sections could be made of paper and releaseable adhesive could be used as the fastening means instead of the hook and loop type fastener. It will further be understood that while the garment measuring system of the present invention has been described for use in taking measurements for a man's custom shirt, it is equally adaptable for use with a woman's blouse or a person's coat. Any garment which requires measurement of the human torso can be measured using the garment measuring system of the present invention.

While a preferred embodiment of a garment measuring system in accordance with the present invention has been set forth fully and completely hereinabove, it will be apparent to one of skill in the art that a number of changes in, for example the particular type of material used, the overall dimensions of the sections and the like may be made without departing from the true spirit and scope of the invention which is to be limited only by the following claims.

What is claimed is:

1. A garment measuring system useable to determine various physical characteristics of a person for whom a garment is to be made, said garment measuring system comprising:

a plurality of cooperating sections, each of said sections being structured to simulate the look and fit of a portion of a garment to be made, said plurality of cooperating sections being adapted to be placed on a person for whom a garment is to be made in a sequence, said plurality of cooperating sections including;

a collar measuring section having a neck measuring tape;

left and right yoke measuring sections securable to each other and including a yoke measuring tape and cooperative with said collar measuring section;

left and right sleeve length measuring means cooperative with said left and right yoke measuring sections; and means for measuring torso dimensions of the person for whom the garment is to be made.

2. The garment measuring system of claim 1 wherein said left and right sleeve length measuring means includes sleeve attaching panels on said left and right yoke measuring sections.

3. The garment measuring system of claim 2 wherein said sleeve attaching panels each have a sleeve length measuring tape.

4. The garment measuring system of claim 3 further including left and right sleeve sections, said left and right sleeve sections being attachable at first ends to said left and right sleeve attaching panels.

5. The garment measuring system of claim 1 wherein said collar measuring section includes an outer collar portion and an inner neck portion and further wherein said neck measuring tape is carried at a free end of said outer collar portion.

6. The garment measuring system of claim 5 wherein said neck measuring tape is bounded by a first portion of a collar securing hook and loop fastener and wherein a free end of said inner neck portion is provided with a second portion of a collar securing hook and loop fastener, said first and second portions of said collar securing hook and loop fasteners cooperating to secure said collar measuring section about the neck of the person.

7. The garment measuring system of claim 1 wherein said collar measuring section includes a front portion, a small yoke portion, and front buttons wherein said collar measuring section is simulative in appearance of a portion of a garment.

8. The garment measuring system of claim 1 wherein one of said left and right yoke measuring sections carries said yoke measuring tape, said yoke measuring tape being bounded by a first portion of a yoke hook and loop fastener and further wherein the other of said left and right yoke measuring sections carries a second portion of a yoke hook and loop fastener, an end of said other of said left and right yoke measuring sections being placeable atop said yoke measuring tape to provide a yoke size measurement.

9. The garment measuring system of claim 8 wherein said left and right yoke sections are attached to each other by said yoke hook and loop fasteners when said end of said other yoke section is placed atop said yoke measuring tape.

10. The garment measuring system of claim 2 wherein said left and right sleeve attaching panels include left and right bicep encircling tape.

11. The garment measuring system of claim 4 wherein said left and right sleeve sections each have a wrist encircling band at a second end.

12. The garment measuring system of claim 4 wherein each of said left and right sleeve sections includes a forearm encircling strap intermediate its first and second ends.

13. The garment measuring system of claim 11 wherein said wrist encircling band on each of said sleeve sections has a cuff measuring tape on a first end of said band.

14. The garment measuring system of claim 13 wherein said cuff measuring tape is bounded by a first portion of a wrist encircling band hook and loop fastener and further wherein a second free end of said wrist encircling band carries a second portion of said wrist encircling band hook and loop fastener.

15. The garment measuring system of claim 1 wherein said means for measuring torso dimensions includes an elongated tape section having a tape section measuring tape bounded by a first portion of a tape section hook and loop fastener at a first end and a second portion of a tape section hook and loop fastener at a second end.

16. A garment measuring system useable to determine various physical characteristics of a person for whom a garment is to be made, said garment measuring system comprising:

a collar measuring section having an outer collar portion and an inner collar portion and further having a neck measuring tape which is carried at a free end of said outer collar portion;

left and right yoke measuring sections securable to each other and including a yoke measuring tape;

left and right sleeve length measuring means; and means for measuring torso dimensions of the person for whom the garment is to be made.

17. The garment measuring system of claim 16 wherein said neck measuring tape is bounded by a first portion of a collar securing hook and loop fastener and wherein a free end of said inner neck portion is provided with a second portion of a collar securing hook and loop fastener, said first and second portions of said collar securing hook and loop fasteners cooperating to secure said collar measuring section about the neck of the person.

18. The garment measuring system of claim 16 wherein said collar measuring section includes a front portion, a small yoke portion, and front buttons wherein said collar measuring section is simulative in appearance of a portion of a garment.

19. The garment measuring system of claim 16 wherein one of said left and right yoke measuring sections carries said yoke measuring tape, said yoke measuring tape being bounded by a first portion of a yoke hook and loop fastener and further wherein the other of said left and right yoke measuring sections carries a second portion of a yoke hook and loop fastener, an end of said other of said left and right yoke measuring sections being placeable atop said yoke measuring tape to provide a yoke size measurement.

20. The garment measuring system of claim 19 wherein said left and right yoke sections are attached to each other by said yoke hook and loop fasteners when said end of said other yoke section is placed atop said yoke measuring tape.

21. A garment measuring system useable to determine various physical characteristics of a person for whom a garment is to be made, said garment measuring system comprising:

a collar measuring section having a neck measuring tape;

left and right yoke measuring sections securable to each other and including a yoke measuring tape;

left and right sleeve length measuring means including sleeve attaching panels on said left and right yoke measuring sections, said sleeve attaching panels each having a sleeve length measuring tape;

left and right sleeve sections, said left and right sleeve sections being attachable at first ends to said left and right sleeve attaching panels, said left and right sleeve sections each having a wrist encircling band at a second end, said wrist encircling band on each of said left and right sleeve sections having a cuff measuring tape on a first end of said band, said cuff measuring tape being bounded by a first portion of a wrist encircling band hook and loop fastener and having a second portion of said wrist encircling band and hook loop fastener on a second free end of said wrist encircling band; and means for measuring torso dimensions of the person for whom the garment is to be made.

* * * * *